US008166691B1

(12) United States Patent
Karfiol

(10) Patent No.: US 8,166,691 B1
(45) Date of Patent: May 1, 2012

(54) AMBIDEXTROUS MAGAZINE CATCH

(75) Inventor: Yury Karfiol, Brooklyn, NY (US)

(73) Assignee: Kimber IP, LLC, Yonkers, NY (US)

( * ) Notice: Subject to any disclaimer, the term of this patent is extended or adjusted under 35 U.S.C. 154(b) by 16 days.

(21) Appl. No.: 12/983,389

(22) Filed: Jan. 3, 2011

(51) Int. Cl.
*F41A 9/61* (2006.01)

(52) U.S. Cl. ..... 42/7; 42/6

(58) Field of Classification Search ..... 42/6, 7, 42/49.01, 18, 22
See application file for complete search history.

(56) References Cited

U.S. PATENT DOCUMENTS

| | | | |
|---|---|---|---|
| 4,236,337 | A | 12/1980 | Beretta |
| 4,326,353 | A | 4/1982 | Ludwig et al. |
| 4,414,769 | A | 11/1983 | Mueschke |
| 4,449,311 | A | 5/1984 | Giragosian |
| 4,521,985 | A | 6/1985 | Smith et al. |
| 4,574,509 | A | 3/1986 | Smith |
| 4,599,818 | A | 7/1986 | Fedora et al. |
| 4,638,581 | A | 1/1987 | Moore |
| 4,713,902 | A | 12/1987 | Wigton |
| 4,759,144 | A | 7/1988 | Egan et al. |
| 4,768,301 | A | 9/1988 | Thomas |
| 4,835,892 | A | 6/1989 | Ruger et al. |
| 4,899,476 | A | 2/1990 | Hindle |
| 5,058,301 | A | 10/1991 | Lishness et al. |
| 5,519,954 | A | 5/1996 | Garrett |
| 5,628,134 | A | 5/1997 | Wesp et al. |
| 7,559,166 | B2 | 7/2009 | Bubits |
| 2006/0123683 | A1 | 6/2006 | Garrett et al. |
| 2010/0287806 | A1 | 11/2010 | Marfione et al. |

*Primary Examiner* — Michael Carone
*Assistant Examiner* — Daniel Troy
(74) *Attorney, Agent, or Firm* — Caesar, Rivise, Bernstein, Cohen & Pokotilow, Ltd.

(57) ABSTRACT

An ambidextrous magazine catch mechanism for a pistol includes a button in the pistol frame. The button has a W-shaped camming surface. A magazine has a catch aperture. A catch includes two upwardly disposed legs connected to one another. A first leg has a tooth to mate with the catch aperture. The first and second legs form a spring having an equilibrium position. When the first leg is pressed toward the second leg, an outward force on the first leg biases the catch toward the equilibrium position. The first leg has a W-shaped camming surface to mate with the camming surface of the button. The button has a neutral position, and a first and second depressed position. In the neutral position, the camming surface of the button mates with the camming surface of the first leg and the tooth is engaged in the aperture to secure the magazine. In the first depressed position, a first side of the button is depressed such that the camming surface of the button moves against the camming surface of the first leg such that the first leg is urged toward the second leg to disengage the tooth from the magazine.

6 Claims, 9 Drawing Sheets

AMBIDEXTROUS MAGAZINE CATCH

BACKGROUND OF THE INVENTION

The present invention relates to hand firearms. More particularly, the present invention is directed to a magazine retainer mechanism that is actuatable from either side of the firearm for left or right handed operation.

Automatic pistols typically utilize latches for locking and unlocking the magazine of the pistol into the magazine chamber, located in the handle of the pistol. Known latches include a sliding type which is seated and guided transversely with respect to the chamber receiving the magazine, so as to engage a notch provided on a lateral surface of the magazine. Most sliding latches heretofore known are unidirectional, for use by one hand only. Some of these may be assembled for use in the right or left hand. Others are truly ambidextrous latches that may be used at any time by either right handed or left handed users. But these are typically difficult to operate, assemble and disassemble Numerous patents are disclosed where the latch is reversible from fixed positions for right handed persons and left handed persons. For example, U.S. Pat. No. 4,236,337 (Beretta) discloses a reversible sliding magazine latch for pistols for right handed or left handed individuals. A spring biased U-shaped latch is located in the pistol handle and may be manually reversed in position.

U.S. Pat. No. 4,449,311 (Girogosian) discloses a reversible magazine latch system for pistols. A latch seat extends through the pistol and may be disposed and retained by the seat in either a left hand or right hand orientation.

U.S. Pat. No. 4,599,818 (Fedora et al.) discloses a magazine catch for a pistol that is reversible for operation from either side of the pistol to release the magazine from the pistol. The catch includes a pin carrying a pair of projections. One of the projections engages a slot in the side of the magazine to retain the magazine in the pistol handle.

U.S. Pat. No. 4,713,902 (Wigton) discloses a magazine catch that includes a lever to draw out the catch. The lever is positioned for operation by the shooter's left thumb in addition to a button release positioned for the right thumb. The lever may be mounted in either of two positions for a left handed or right handed shooter.

U.S. Pat. No. 4,899,476 (Hindle) discloses a reversible magazine catch mechanism that includes an actuator button removably fitted onto a shaft which is disposed for slideable axial movement in a bore which extends laterally through the frame of the gun.

U.S. Pat. No. 5,058,301 (Lishness et al.) discloses a reversible magazine catch that includes a housing, a moveable mounting pin and a coiled spring. The housing has a spring channel that is perpendicular and intersecting a spring hole and a magazine locking rib. The spring biases the housing relative to the pin and forms a slidable friction hold of the pin.

It is desirable to have magazine catches that are truly ambidextrous in that they can be used by both left handed and right handed users without rearranging the latch mechanism. For example, U.S. Pat. No. 4,521,985 (Smith et al.) discloses an ambidextrous magazine release for gun magazines for retrofit into an automatic pistol. A pivoting lever with a cam surfaced catch on the end engages the magazine.

U.S. Pat. No. 4,326,353 (Ludwig et al.) discloses a magazine catch release for a pistol that can be actuated from either side of the pistol. An actuating member extends on both sides of the pistol and is connected with a locking lever so that actuation of the actuation member pivots the lever to unlock the magazine.

U.S. Pat. No. 4,574,509 (Smith) discloses an ambidextrous magazine catch which is operable by either hand on either side of the firearm. An aperture in the front wall of the magazine is engaged by the nose of the catch that is pivotable in a slot in the wall of the magazine well from a central position in which the catch nose engages the aperture to either of two extreme positions in which the nose is withdrawn from the aperture.

U.S. Pat. No. 4,835,892 (Ruger et al.) discloses an ambidextrous magazine latch for a pistol in which a hand-operable cross lever is positioned by resilient means against the pistol's frame with lever ends that protrude from both sides of the pistol's handle. By applying hand pressure to either lever end, the lever twists against the resilient means to withdraw the latch protrusion out of the magazine to release the magazine.

U.S. Pat. No. 5,519,954 (Garrett) discloses an ambidextrous magazine release mechanism for firearms that may be operable from either the right or left side of the firearm. The release is nonsymmetrical thereby causing different action depending upon whether a left side or right side button is depressed.

U.S. Patent Application No. 2006/0123683 (Garrett et al.) discloses an ambidextrous magazine release mechanism for firearms that may be operable from either the right or left side of the firearm. The release is nonsymmetrical thereby causing different action depending upon whether a left side or right side button is depressed.

U.S. Pat. No. 7,559,166 (Bubits) discloses a pistol having a magazine catch that is releasable from either side. A sliding block is arranged so as to be displaceable in a transverse direction and is held in its middle position by at least one spring. The sliding block has a vertical groove on either side of the lug which can be brought into the path of movement of the lug during insertion of the magazine by displacement of the sliding block in either one of two directions.

Other magazine catches operable for either right or left handed users include, for example, U.S. Pat. No. 4,638,581 (Moore) discloses an ambidextrous magazine catch for a pistol. The magazine catch is disposed transversely through the frame and is biased in a position that retains the magazine.

U.S. Pat. No. 4,759,144 (Egan et al.) discloses an ambidextrous release for a magazine in a pistol that uses a catch lock release in which a catch lock release lever is positioned on the gun butt or grip.

U.S. Pat. No. 4,768,301 (Thomas) discloses a magazine latch that includes two positive detent latches in a concave portion and separated by a central groove. The detente latches have an outer arched or curved surface.

U.S. Pat. No. 4,835,892 (Ruger et al.) discloses an ambidextrous magazine latch for a pistol in which a hand-operable cross lever is positioned by resilient means against the pistol's frame with lever ends that protrude from both sides of the pistol's handle. By applying hand pressure to either lever end, the lever twists against the resilient means to withdraw the latch protrusion out of the magazine to release the magazine.

U.S. Pat. No. 5,628,134 (Wesp et al.) discloses a magazine retainer for a firearm that is mounted to pivot in a recess in the stock of the pistol. The magazine retainer is provided with two lateral actuation plates which are positioned in openings on both sides of the rear portion of the trigger guard and these trigger guard openings have a depth which corresponds to the thickness of the actuation plates.

U.S. Patent App. Pub. No. 2010/0287806 (Marfione et al.) discloses a magazine release assembly for use with a pistol that has a pin configured to be positioned through an end of a pistol trigger guard. A magazine release arm is pivotally mounted to the pin. The catch has a ledge which engages a notch on the magazine wall when the release arm is pivoted to an engaged position and which pivots away from the notch when the release arm is disengaged. There may be two magazine release arms, making the magazine release assembly ambidextrous.

Finally, in a related invention, but no specifically directed to a magazine latch, U.S. Pat. No. 4,414,769 (Mueschke) is directed to an ambidextrous safety for a pistol in which finger levers are located on both sides of the pistol which move together as a pair utilizing a frame structure.

It would be desirable to have an ambidextrous magazine catch that avoids unnecessary side load forces to the magazine from the catch mechanism.

It would further be desirable to provide an easy and controlled ambidextrous latch mechanism that can be easily assembled and disassembled.

All references cited herein are incorporated herein by reference in their entireties.

BRIEF SUMMARY OF THE INVENTION

An ambidextrous magazine catch mechanism for a pistol is provided where the pistol has a magazine and a frame having a magazine chamber to receive the magazine. The magazine catch mechanism includes a two-sided button slidably disposed in a lateral aperture in the frame adjacent to the magazine. The button is symmetric about a midpoint of the button and has a W-shaped camming surface comprising a pair of U-shaped camming surfaces adjacent to one another and extending longitudinally on the button and connected at a central hump of the W-shaped camming surface. The central hump is at the midpoint of the button. The magazine has at least one catch aperture. A catch is provided that includes two upwardly disposed legs connected to one another forming a generally U-shaped body. A first leg of the two upwardly disposed legs has at least one tooth adapted to mate with the at least one catch aperture in the magazine. The first leg and the second leg form a spring having an equilibrium position wherein no force is applied to the first leg relative to the second leg, and wherein when the first leg is pressed toward said second leg. An outward force created on the first leg biases the catch toward the equilibrium position. The first leg has a W-shaped camming surface thereon, adapted to mate with the W-shaped camming surface of the button.

The button has a neutral position, a first depressed position and a second depressed position. In the neutral position, the W-shaped camming surface of the button mates with the W-shaped camming surface of the first leg and the tooth is engaged in the catch aperture in the magazine to secure the magazine in the magazine chamber. In the first depressed position, a first side of the button is depressed such that the first side of the button moves laterally inward into the frame and the W-shaped camming surface of the button moves against the W-shaped camming surface of the first leg such that the first leg of the catch is urged toward the second leg of the catch. Here, the tooth disengages from the catch aperture in the magazine thereby releasing the magazine from the magazine chamber. In the second depressed position, a second side of the button is depressed such that the second side of the button moves laterally inward into the frame and the W-shaped camming surface of the button moves against the W-shaped camming surface of the first leg such that the first leg of the catch is urged toward the second leg of the catch. Here, the tooth disengages from the catch aperture in the magazine thereby releasing the magazine from the magazine chamber.

A guide may be disposed in a guide aperture in the frame adjacent to the button, wherein a groove in the button slidably engages a portion of the guide to align the button with respect to the catch. A biasing member may be used to cause the button to be biased to the neutral position. Finally, the magazine may have two front walls forming a generally U-shaped front surface, wherein each of the front walls has a catch aperture.

BRIEF DESCRIPTION OF SEVERAL VIEWS OF THE DRAWINGS

The invention will be described in conjunction with the following drawings in which like reference numerals designate like elements and wherein.

DETAILED DESCRIPTION OF THE INVENTION

The invention will be illustrated in more detail with reference to the following embodiments, but it should be understood that the present invention is not deemed to be limited thereto.

Figure 1:
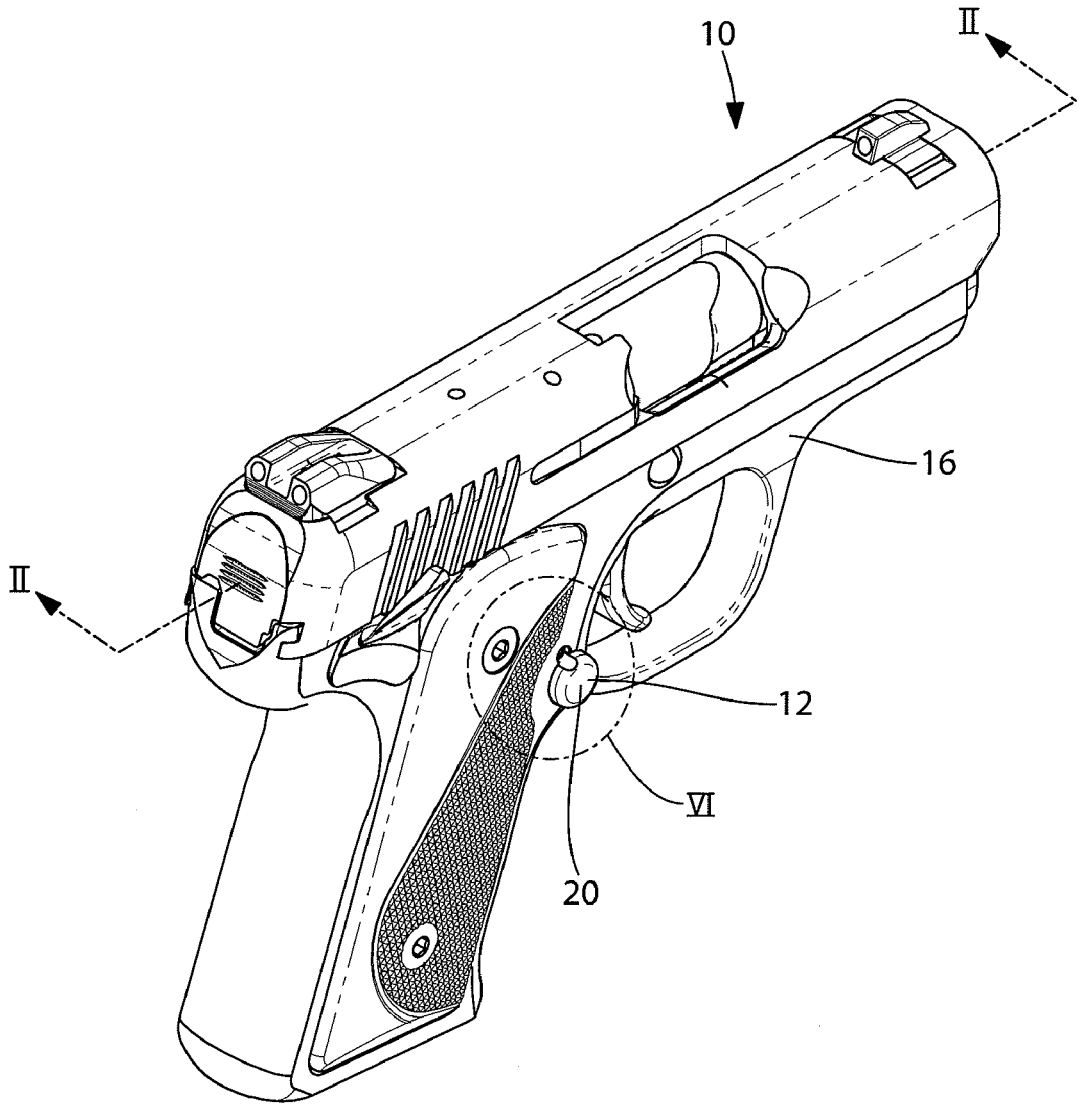
FIG. 1 is an isometric view of a pistol having an ambidextrous magazine catch mechanism in accordance with a preferred embodiment of the present invention.
Figure 2:
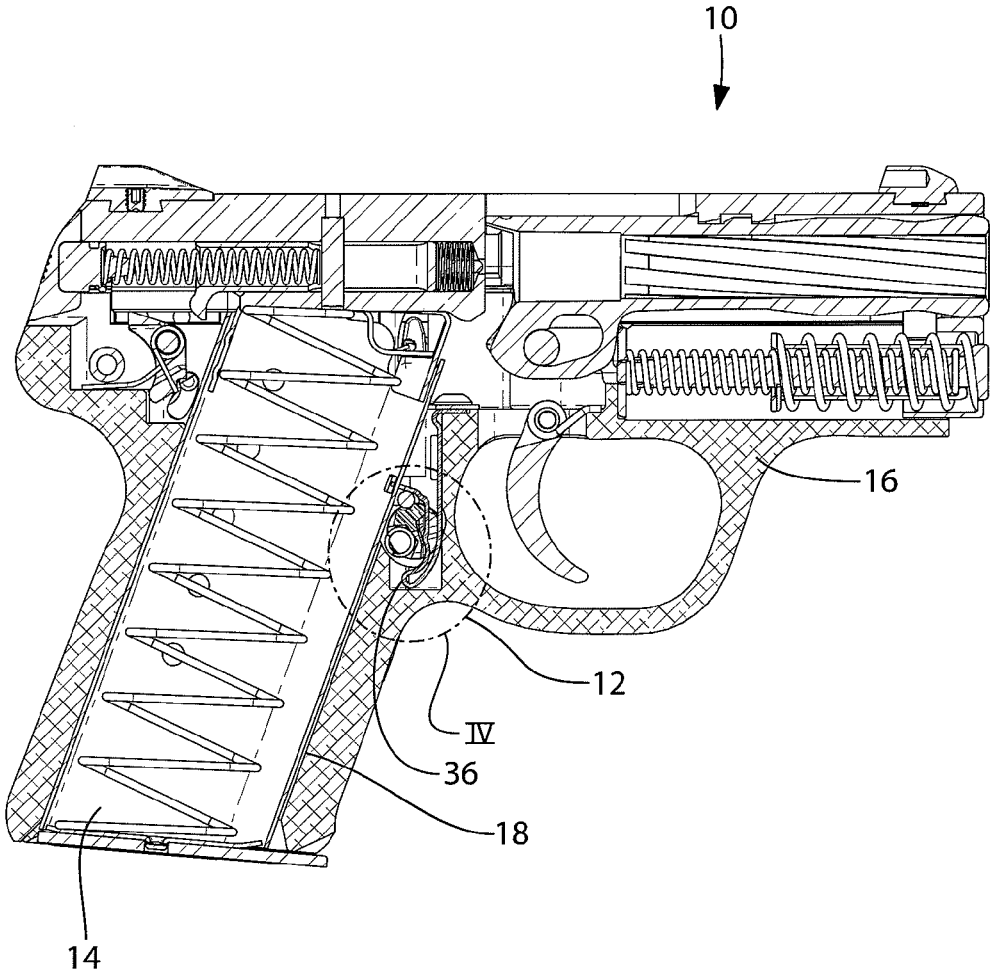
FIG. 2 is a cross-sectional view of the pistol having an ambidextrous magazine catch mechanism of FIG. 1, taken substantially along lines II-II of FIG. 1.
Figure 3:
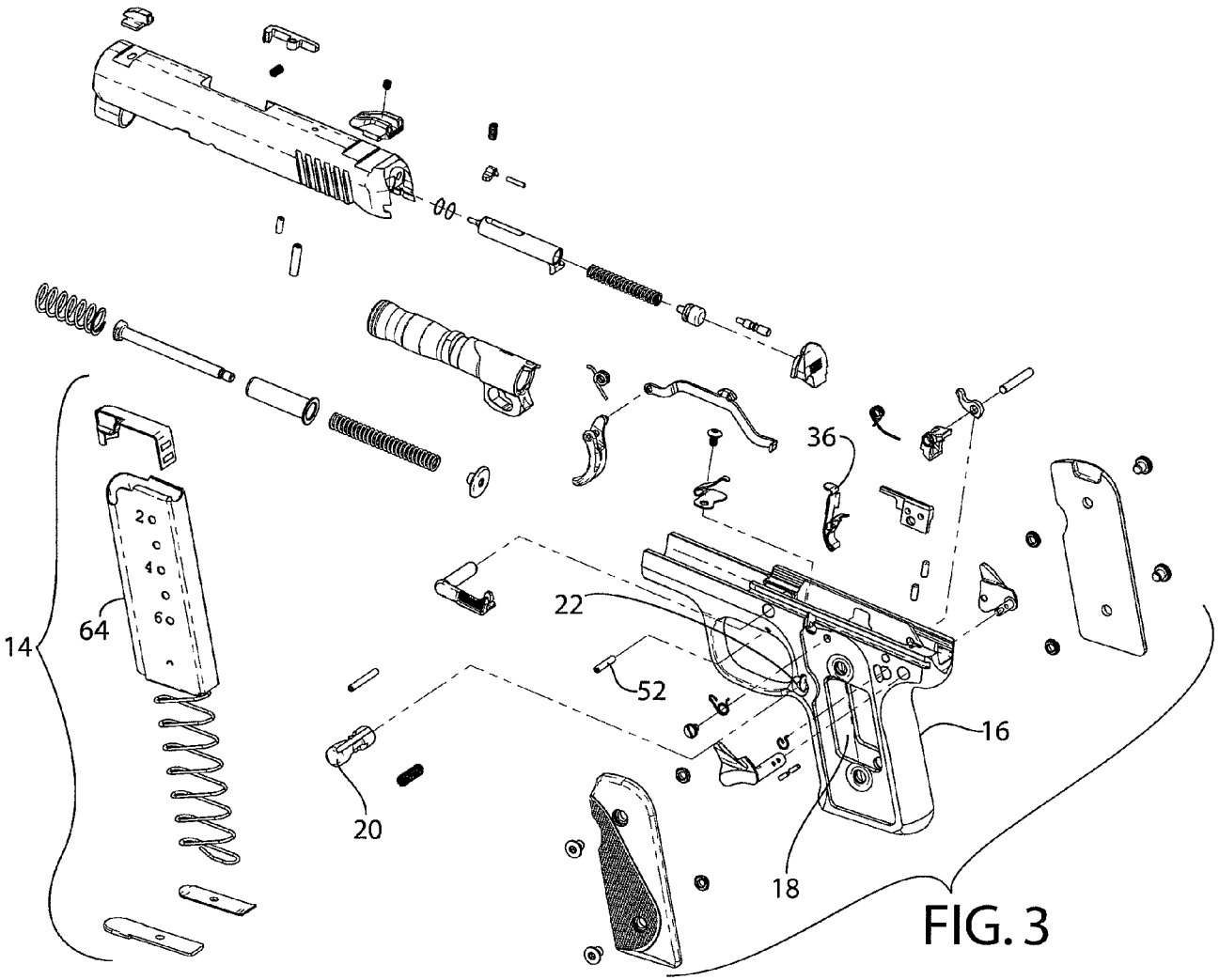
FIG. 3 is an exploded isometric view of the pistol of FIG. 1.
Figure 4:
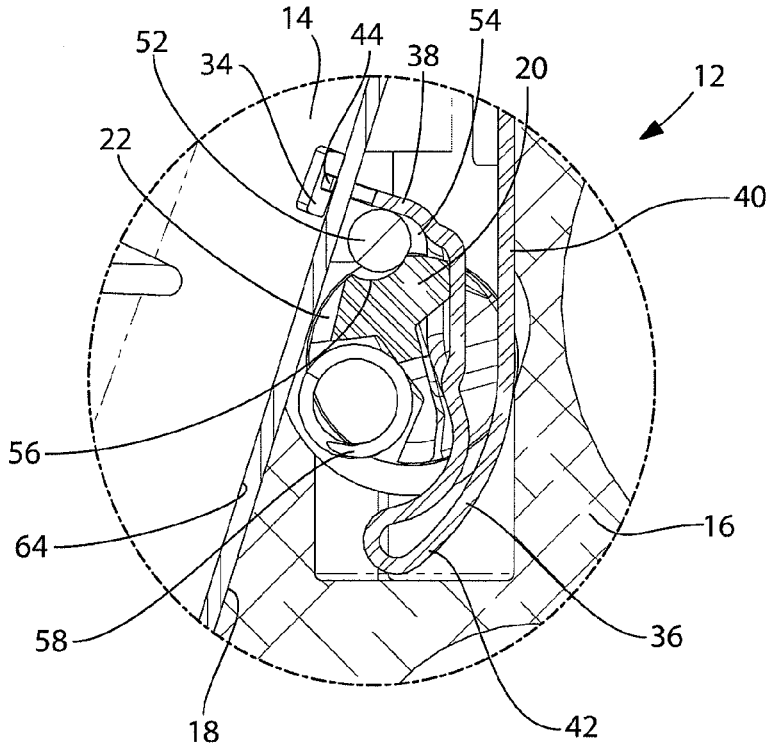
FIG. 4 is a detail view of the pistol of FIG. 1, taken at detail IV of FIG. 2, showing the ambidextrous magazine catch mechanism in a secured position.

Referring now to the drawings, wherein like reference numbers refer to like elements throughout the several views, there is shown in FIGS. 1-3, a pistol 10 having an ambidextrous magazine catch mechanism 12 in accordance with a preferred embodiment of the present invention. The pistol 10 is preferably a semi-automatic type pistol, having a magazine 14 (see FIGS. 2, 3 and 12) and a frame 16 having a magazine chamber 18 to receive the magazine 14.

As can be seen in FIGS. 4-11 the magazine catch mechanism 12 includes a two-sided button 20 slidably disposed in a lateral aperture 22 in the frame 16 adjacent to the magazine 14 and magazine chamber 18. The button 20 is symmetric about a midpoint 24 of the button 20 and has a W-shaped camming surface 26 comprising a pair of U-shaped camming surfaces 28, adjacent to one another and extending longitudinally on the button 20 and connected at a central hump 32 of the W-shaped camming surface 26. The central hump 32 is at the midpoint 24 of the button 20.

Figure 5A:
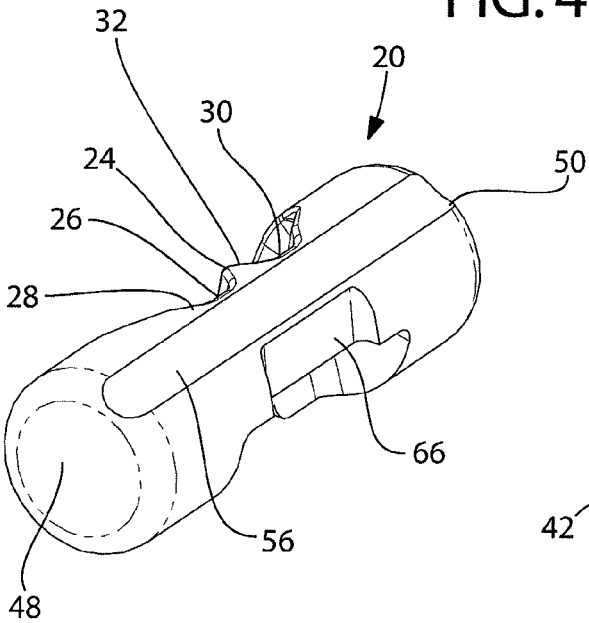
FIG. 5A is an isometric view of a two-sided button of the ambidextrous magazine catch mechanism of FIG. 4.
Figure 5B:
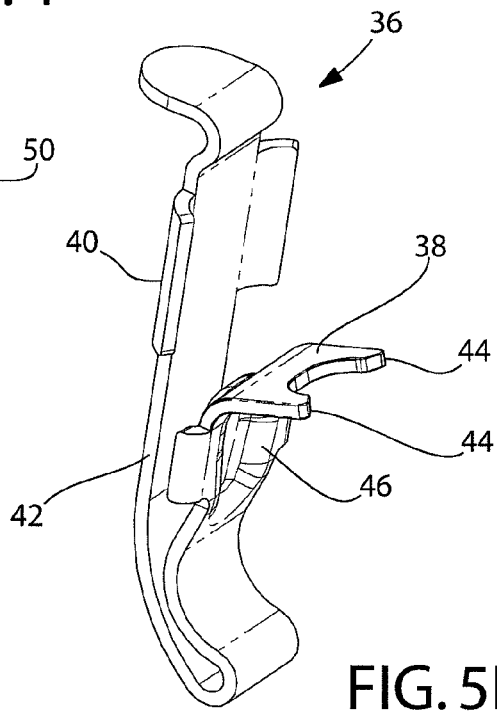
FIG. 5B is an isometric view of a catch of the ambidextrous magazine catch mechanism of FIG. 4.
Figure 12:
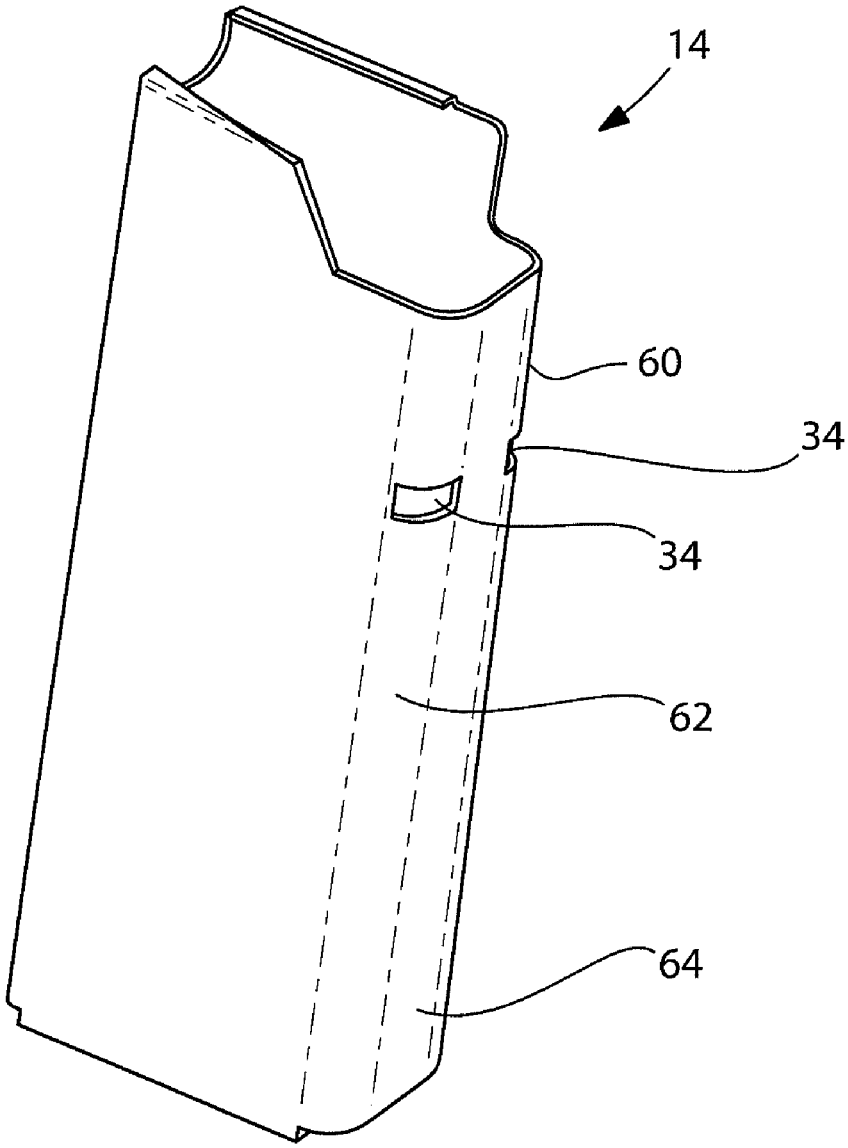
FIG. 12 is an isometric view of the magazine of the pistol of FIG. 1.

As best seen in FIG. 12, the magazine 14 has one or more catch apertures 34 to receive a catch 36 at least one tooth 44 of the catch mechanism 12. The catch 36 secures the magazine 14 in the magazine chamber 18 by securing the apertures 34 in the magazine 14. As best seen in FIG. 5B, the catch 36 includes two upwardly disposed legs 38, 40 connected to one another, forming a generally U-shaped body 42. The first leg 38 has at least one tooth 44 to mate with the catch aperture 34 or apertures in the magazine 14. See FIG. 4 (latched; button 20 undepressed, in neutral position) as compared with FIG. 8 (unlatched, button 20 depressed from either side). The first leg 38 and said second leg 40 form a spring having an equilibrium position wherein when no force is applied to the first leg 38 relative to the second leg 40. When the first leg 38 is pressed toward said second leg 40, an outward force on the first leg 38 biases the catch 36 and button 20 toward the equilibrium position. The first leg 38 has a W-shaped camming surface 46 thereon, adapted to mate with the W-shaped camming surface 36 of the button 20.

The button 20 has a neutral position (see FIG. 6A), a first depressed position (direction A of FIG. 7) and a second depressed position (see FIG. 6B); the second depressed position is the mirror image of the first depressed position). In the neutral position, the W-shaped camming surface 26 of the button 20 aligns with the W-shaped camming surface 46 of the first leg 38 and the tooth 44 (or teeth) is engaged in the catch aperture 34 in the magazine 14 to secure the magazine 14 in the magazine chamber 18.

In the first depressed position, a first side 48 of the button 20 is depressed such that the first side 48 of the button 20 moves laterally inward into the frame 16 (direction B of FIG. 8), the W-shaped camming surface 26 of the button 20 moves against the W-shaped camming surface 46 of the first leg 38 such that the first leg 38 of the catch 36 is urged toward the second leg 40 of the catch 36. Here, the tooth 44 disengages from the catch aperture 34 in the magazine 14 thereby releasing the magazine 14 from the magazine chamber 18. In the second depressed position, a second side 50 of the button 20 is depressed such that the second side 50 of the button 20 moves laterally inward into the frame 16, the W-shaped camming surface 26 of the button 20 moves against the W-shaped camming surface 46 of the first leg 38 such that the first leg 38 of the catch 36 is urged toward the second leg 40 of the catch 36 wherein the tooth 44 disengages from the catch aperture 34 in the magazine 14, thereby releasing the magazine 14 from the magazine chamber 18 in the frame 16 of the pistol 10.

Figure 9:
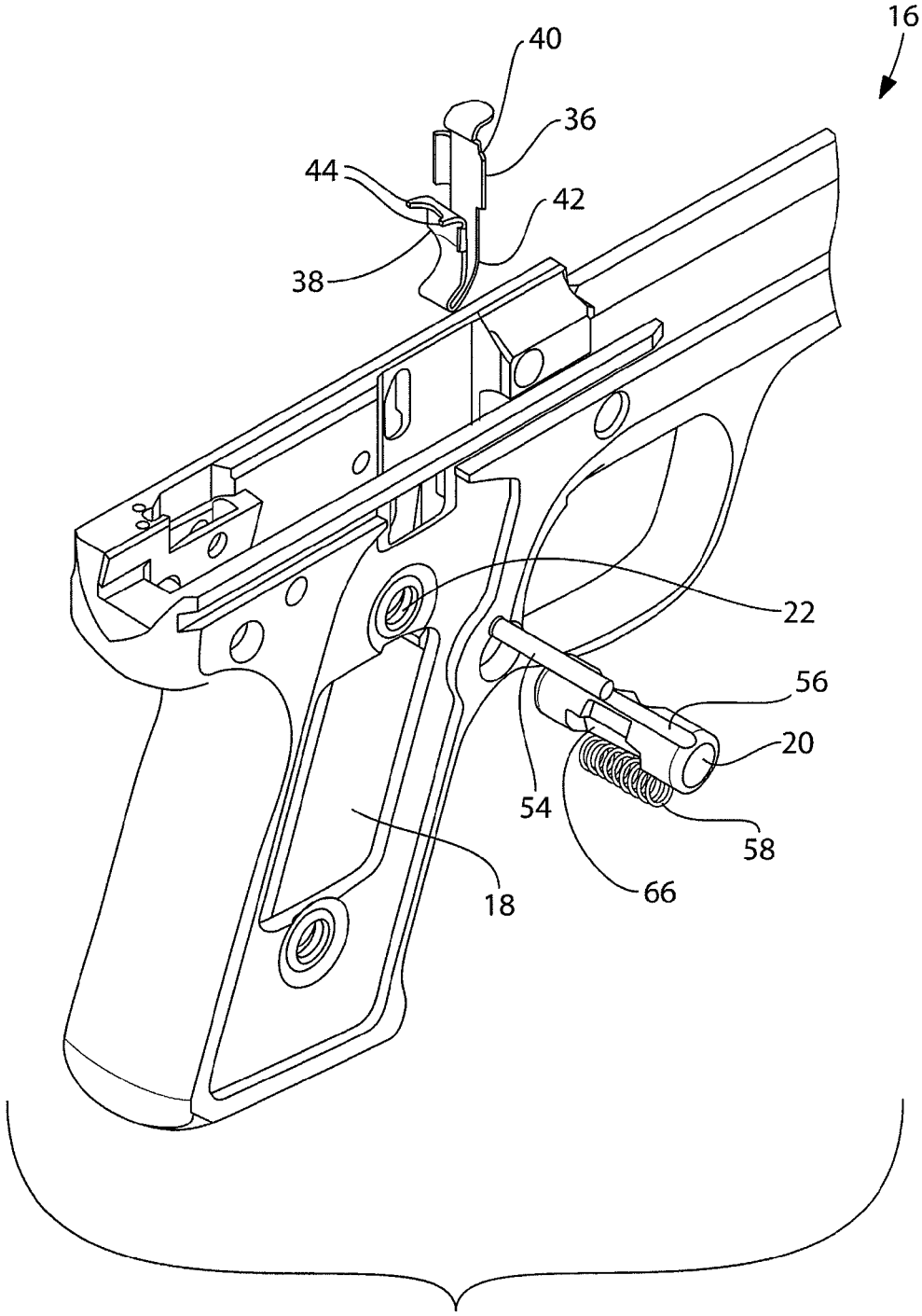
FIG. 9 is a partial exploded isometric view of the frame and the ambidextrous catch mechanism of the pistol of FIG. 1.
Figure 10:
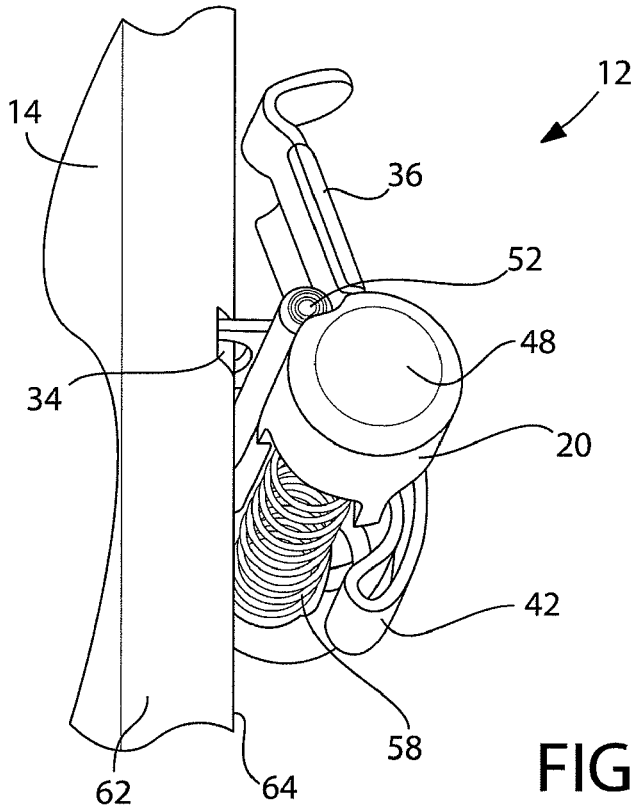
FIG. 10 is a partial isometric side view of the ambidextrous catch mechanism of the pistol of FIG. 1.
Figure 11:
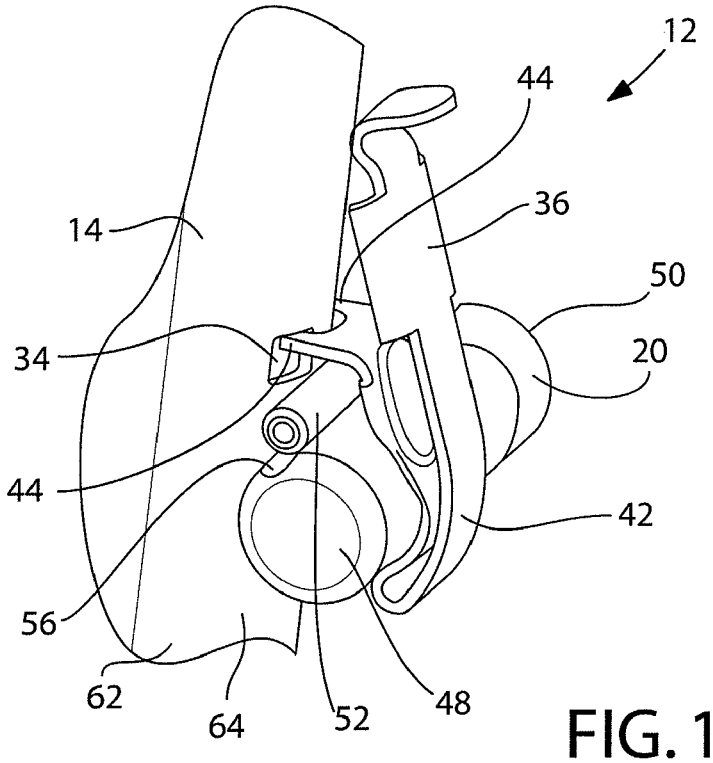
FIG. 11 is another partial isometric side view of the ambidextrous catch mechanism of the pistol of FIG. 1.

As best seen in FIGS. 9-11, a guide 52 may be disposed in a guide aperture 54 in the frame 16 adjacent to the button 20. Here, a groove 56 in the button 20 slidably engages a portion of the guide 56 to align the button 20 with respect to the catch 36 and thereby keeping it a proper position.

Figure 6A:
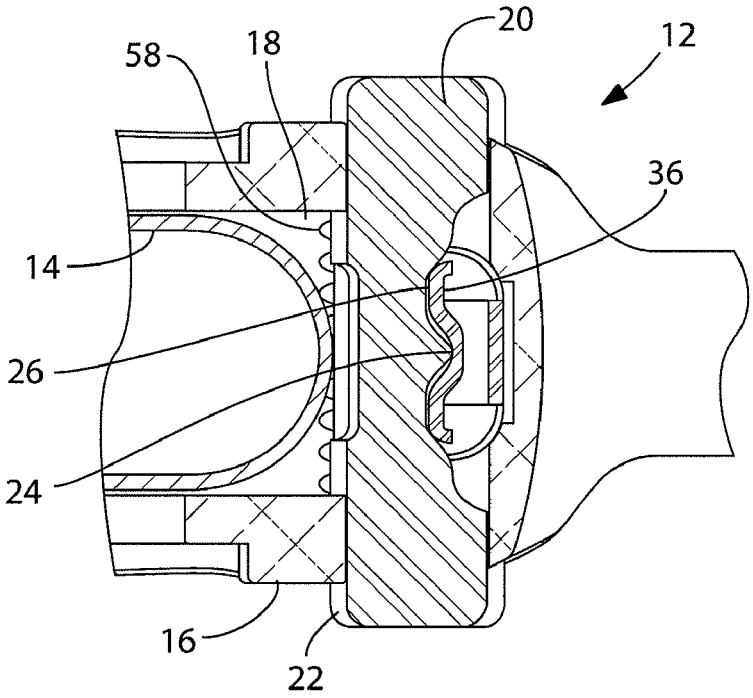
FIG. 6A is an enlarged cross sectional view of a portion of the ambidextrous catch mechanism of FIG. 4, shown with the button in a neutral position.
Figure 6B:
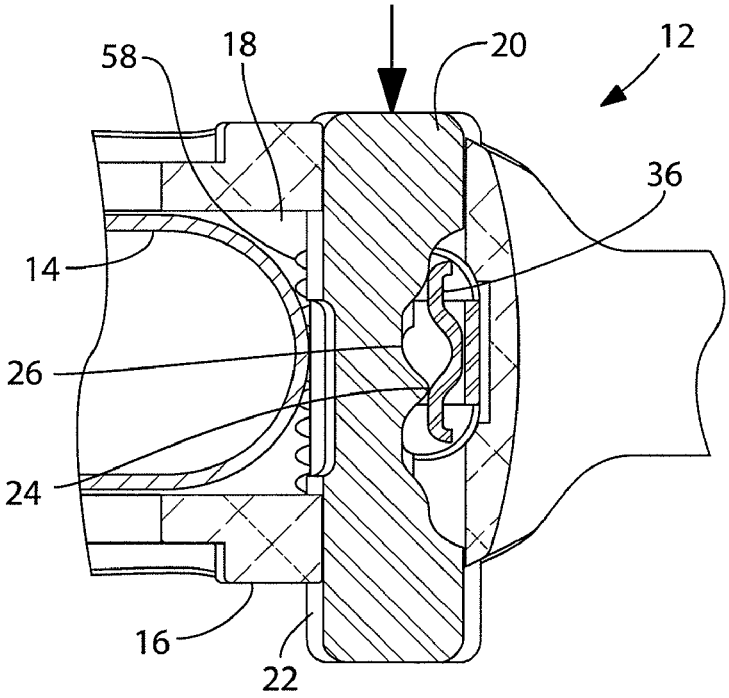
FIG. 6B is an enlarged cross sectional view of a portion of the ambidextrous catch mechanism of FIG. 4, shown with the button in a depressed position.
Figure 7:
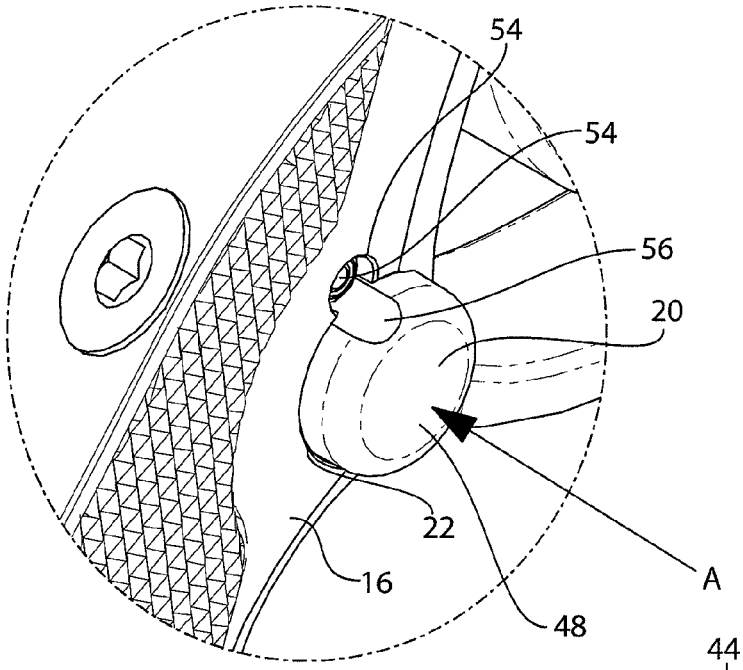
FIG. 7 is an isometric detail view of the pistol of FIG. 1, taken at detail VI of FIG. 1, shown with the button in a neutral position.
Figure 8:
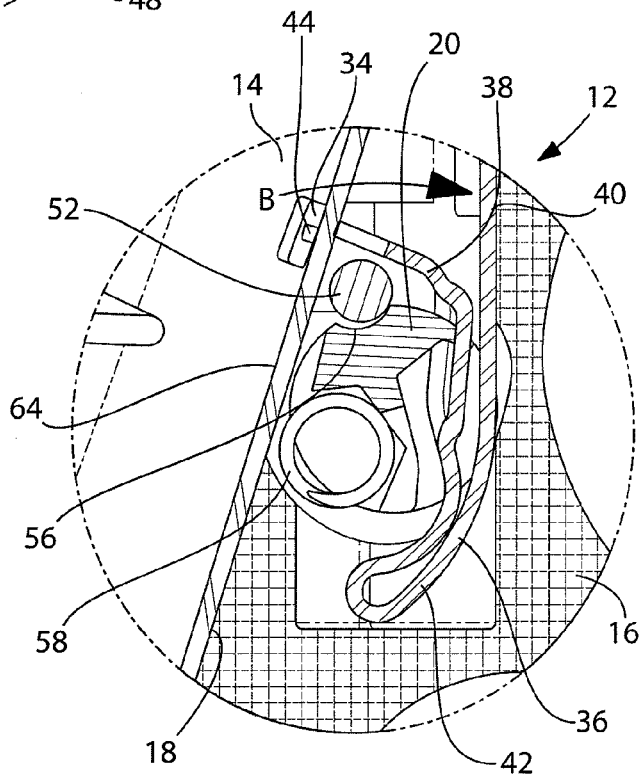
FIG. 8 is a detail view of the pistol of FIG. 1, taken at detail IV of FIG. 2, showing the ambidextrous magazine catch mechanism in a secured position.

As best seen in FIGS. 9 and 10, a biasing member such as spring 58 may be used to cause the button 20 to be biased to the neutral position. This is accomplished by the spring 58 sitting in a notch 66 in the button 20 and a notch 68 in the frame 16. FIG. 6A shows the button in its neutral position, while FIG. 6B shows the button in a depressed position (magazine 14 released from the magazine chamber). In a preferred configuration of the magazine 14, but not required, the magazine 14 may have two front walls 60, 62 forming a generally U-shaped front surface 64, wherein each of the front walls 60, 62 has one of the catch apertures 34.

While the invention has been described in detail and with reference to specific embodiments thereof, it will be apparent to one skilled in the art that various changes and modifications can be made therein without departing from the spirit and scope thereof.

What is claimed is:

1. An ambidextrous magazine catch mechanism for a pistol having a magazine, a frame having a magazine chamber to receive the magazine, the magazine catch mechanism comprising:

(a) a two-sided button slidably disposed in a lateral aperture in the frame adjacent to the magazine, the button being symmetric about a midpoint of the button, the button having a W-shaped camming surface comprising a pair of U-shaped camming surfaces adjacent to one another and extending longitudinally on the button and connected at a central hump of the W-shaped camming surface, the central hump being at the midpoint of the button;

(b) a magazine having at least one catch aperture;

(c) a catch, comprising:

(i) two upwardly disposed legs connected to one another forming a generally U-shaped body, a first leg of the two upwardly disposed legs having at least one tooth adapted to mate with the at least one catch aperture in the magazine;

(ii) said first leg and said second leg forming a spring having an equilibrium position wherein no force is applied to the first leg relative to the second leg, and wherein when the first leg is pressed toward said second leg, an outward force created on the first leg biases the catch toward the equilibrium position; and (iii) said first leg having a W-shaped camming surface thereon, adapted to mate with the W-shaped camming surface of the button;

(d) said button having a neutral position, a first depressed position and a second depressed position, wherein, in the neutral position, the W-shaped camming surface of the button mates with the W-shaped camming surface of the first leg and the at least one tooth is engaged in the at least one catch aperture in the magazine to secure the magazine in the magazine chamber;

(e) wherein, in the first depressed position, a first side of the button is depressed such that the first side of the button moves laterally inward into the frame, the W-shaped camming surface of the button moves against the W-shaped camming surface of the first leg such that the first leg of the catch is urged toward the second leg of the catch wherein the at least one tooth disengages from the at least one catch aperture in the magazine thereby releasing the magazine from the magazine chamber; and (f) wherein, in the second depressed position, a second side of the button is depressed such that the second side of the button moves laterally inward into the frame, the W-shaped camming surface of the button moves against the W-shaped camming surface of the first leg such that the first leg of the catch is urged toward the second leg of the catch wherein the at least one tooth disengages from the at least one catch aperture in the magazine thereby releasing the magazine from the magazine chamber.

2. The ambidextrous magazine catch mechanism of claim 1, further including a guide disposed in a guide aperture in the frame adjacent to the button, wherein a groove in the button slidably engages a portion of the guide to align the button with respect to the catch.

3. The ambidextrous magazine catch mechanism for of claim 1, further including a biasing member to cause the button to be biased to the neutral position.

4. The ambidextrous magazine catch mechanism of claim 1, wherein the magazine has two front walls, said two front walls forming a generally U-shaped front surface, wherein each of the front walls has one of the at least one catch apertures.

5. An ambidextrous magazine catch mechanism for a pistol having a magazine, a frame having a magazine chamber to receive the magazine, the magazine catch mechanism comprising:

(a) a two-sided button slidably disposed in a lateral aperture in the frame adjacent to the magazine, the button being symmetric about a midpoint of the button, the button having a W-shaped camming surface comprising a pair of U-shaped camming surfaces adjacent to one another and extending longitudinally on the button and connected at a central hump of the W-shaped camming surface, the central hump being at the midpoint of the button;

(b) a magazine having at least one catch aperture;

(c) a catch, comprising:

(i) two upwardly disposed legs connected to one another forming a generally U-shaped body, a first leg of the two upwardly disposed legs having at least one tooth adapted to mate with the at least one catch aperture in the magazine;

(ii) said first leg and said second leg forming a spring having an equilibrium position wherein no force is applied to the first leg relative to the second leg, and wherein when the first leg is pressed toward said second leg, an outward force created on the first leg biases the catch toward the equilibrium position;

(iii) said first leg having a W-shaped camming surface thereon, adapted to mate with the W-shaped camming surface of the button;

(d) a guide disposed in a guide aperture in the frame adjacent to the button, wherein a groove in the button slidably engages a portion of the guide to properly align the button with respect to the catch;

(e) a biasing member to cause the button to be biased to the neutral position;

(f) said button having a neutral position, a first depressed position and a second depressed position, wherein, in the neutral position, the W-shaped camming surface of the button mates with the W-shaped camming surface of the first leg and the at least one tooth is engaged in the at least one catch aperture in the magazine to secure the magazine in the magazine chamber;

(g) wherein, in the first depressed position, a first side of the button is depressed such that the first side of the button moves laterally inward into the frame, the W-shaped camming surface of the button moves against the W-shaped camming surface of the first leg such that the first leg of the catch is urged toward the second leg of the catch wherein the at least one tooth disengages from the at least one catch aperture in the magazine thereby releasing the magazine from the magazine chamber; and (h) wherein, in the second depressed position, a second side of the button is depressed such that the second side of the button moves laterally inward into the frame, the W-shaped camming surface of the button moves against the W-shaped camming surface of the first leg such that the first leg of the catch is urged toward the second leg of the catch wherein the at least one tooth disengages from the at least one catch aperture in the magazine thereby releasing the magazine from the magazine chamber.

6. The ambidextrous magazine catch for mechanism of claim 5, wherein the magazine has two front walls, said two front walls forming a generally U-shaped front surface, wherein each of the front walls has one of the at least one catch apertures.

* * * * *